US006733211B1

(12) United States Patent
Durie

(10) Patent No.: US 6,733,211 B1
(45) Date of Patent: May 11, 2004

(54) 3-D SANDWICH PREFORMS AND A METHOD TO PROVIDE THE SAME

(75) Inventor: Angela Durie, Randwick (AU)

(73) Assignee: K.U. Leuven Research & Development, Leuven (BE)

( * ) Notice: Subject to any disclaimer, the term of this patent is extended or adjusted under 35 U.S.C. 154(b) by 107 days.

(21) Appl. No.: 10/048,726

(22) PCT Filed: Jul. 31, 2000

(86) PCT No.: PCT/EP00/07366

§ 371 (c)(1),
(2), (4) Date: May 13, 2002

(87) PCT Pub. No.: WO01/09419

PCT Pub. Date: Feb. 8, 2001

(30) Foreign Application Priority Data

Jul. 31, 1999 (GB) ..... 9918011

(51) Int. Cl.[7] ..... D03D 11/00
(52) U.S. Cl. ..... 405/383 R; 139/408

(58) Field of Search ..... 139/384 R, 408, 139/409, 410, 411, 412, 413, 414, 415; 442/205, 206, 207

(56) References Cited

U.S. PATENT DOCUMENTS

| | | | | |
|---|---|---|---|---|
| 3,008,213 A | * | 11/1961 | Foster et al. | 28/158 |
| 3,048,198 A | * | 8/1962 | Koppelman et al. | 139/384 R |
| 3,670,504 A | | 6/1972 | Hayes | |
| 5,040,572 A | * | 8/1991 | Lindberg | 139/410 |

FOREIGN PATENT DOCUMENTS

| | | |
|---|---|---|
| DE | 44 28 238 A1 | 2/1996 |
| GB | 1 217 823 | 12/1970 |
| WO | WO 88 09404 | 12/1988 |

* cited by examiner

*Primary Examiner*—Danny Worrell
(74) *Attorney, Agent, or Firm*—Barnes & Thornburg

(57) ABSTRACT

The present invention describes 3-D woven structures including two woven fabric layers and uniting yarns between the layers whereby the uniting yarns may have any angle with respect to the fabric. Methods of manufacture of these structures are described.

20 Claims, 10 Drawing Sheets

3-D SANDWICH PREFORMS AND A METHOD TO PROVIDE THE SAME

The present invention relates to 3-D woven textile products and to methods and machines for making the same. These woven products may be included in other structures, e.g. coated with thermoplastic or thermosetting resins or embedded in other materials such as foams, elastomers, rubbers, polymers etc.

BACKGROUND

Composite sandwich structures can be produced from three-dimensional textile preforms that are manufactured using conventional velvet or face-to-face weaving technology. The woven fabric has two distinct separated layers, which are joined together with a 'pile' yarn during the fabric forming process.

In subsequent processing, the two layers form the surfaces of a sandwich panel and the pile forms the core. The mechanical properties of these structures can be tailored to a limited extent through choice of surface and pile fiber architecture. However a feature inherent to conventional weaving processes, and hence face-to-face weaving, is that the fiber is predominantly oriented at the primary weaving axes of warp and weft, which are usually orthogonal to each other. As a result, the mechanical properties of the preforms are restricted. The shear strength between the surfaces can be enhanced to a limited degree by altering the sequence of weaving of the pile yarns to form an 'angle interlock' arrangement, or ±45° warp pile. However, the processing restrictions of standard weaving technology limits this pile configuration, and hence elevates shear strength in the warp direction only.

To expand the application of 3-D textile sandwich preforms, there needs to be more options for engineering their mechanical performance by incorporating multiaxial fiber orientation both on the surface and in the pile.

SUMMARY OF THE INVENTION

The present invention relates to a method of producing angled weft oriented pile in sandwich preforms.

In particular the present invention relates to a woven fabric structure comprising two woven fabric sheets each made up of warp and weft threads, the fabric sheets being parallel to and facing each other, the two fabric sheets being linked to each other by first uniting threads, the direction of at least some of said first uniting threads having a component in the weft direction which makes an angle of between ±15 and ±75° with the plane of the fabric sheets, whereby a first uniting thread trapped in a first position in a first of the two fabric sheets is trapped in the second of the two fabric sheets at a second position equivalent to at least one warp thread removed from the first position.

The present invention may also provide a woven fabric structure comprising two woven fabric sheets each made up of warp and weft threads, the fabric sheets being parallel to and facing each other, the two fabric sheets being linked to each other by first uniting threads, the direction of at least some of said first uniting threads having a component which lies in a plane parallel to the planes of the first and second fabric sheets and which makes an angle of between ±15 and ±165° with the direction of the warp threads, whereby a first uniting thread trapped in a first position in a first of the two fabric sheets is trapped in the second of the two fabric sheets at a second position displaced in the warp and/or weft direction from the first position. The distance of the displacement is at least one warp or weft thread separation distance, for example is preferably two or more warp and/or weft thread separation distances.

The present invention may also provide a method of weaving a fabric structure comprising two woven fabric sheets each made up of warp and weft threads, the fabric sheets being parallel to and facing each other, comprising the steps of:

linking the two fabric sheets to each other by first uniting threads, the direction of at least some of said first uniting threads having a component in the weft direction which makes an angle of between ±15 and ±75° with the plane of the fabric sheets by trapping a first uniting thread in a first position in a first of the two fabric sheets and subsequently trapping the same thread in the second of the two fabric sheets at a second position displaced in the weft direction from the first position. The distance of the displacement is at least one warp thread separation distance, for example is preferably two or more warp thread separation distances.

The present invention may provide a method of forming a woven fabric structure comprising two woven fabric sheets each made up of warp and weft threads, the fabric sheets being parallel to and facing each other, comprising the steps of: linking the two fabric sheets to each other by first uniting threads, the direction of at least some of said first uniting threads having a component which lies in a plane parallel to the planes of the first and second fabric sheets and making an angle of between ±15 and ±165° with the direction of the warp threads by trapping a first uniting thread trapped in a first position in a first of the two fabric sheets and trapping the same first uniting thread in the second of the two fabric sheets at a second position displaced in the warp and/or weft direction equivalent from the first position. The distance of the displacement is at least one warp or weft thread separation distance, for example is preferably two or more warp and/or weft thread separation distances.

The present invention may also provide a weaving loom adapted to carry out any of the methods in accordance with the present invention. In particular, the loom may be adapted to manipulate pile threads in front of the reed by transferring one or more pile threads in the weft direction and trapping these at the transferred position in one of a first and second fabric sheet being woven simultaneously on the loom.

DEFINITIONS

Figure 1:
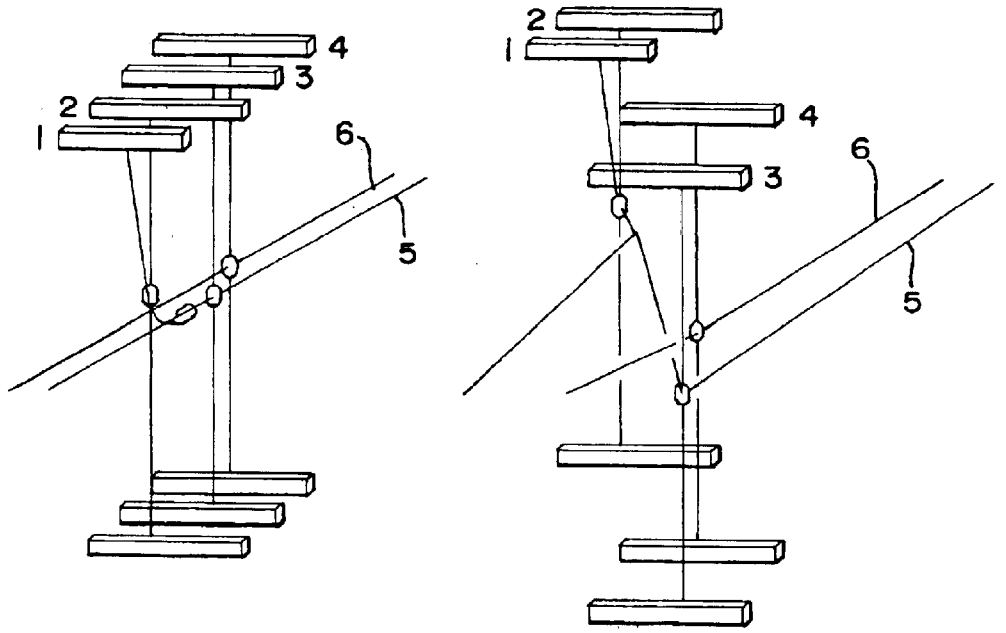
FIG. 1: Basic operation of conventional cord doup leno weaving.

"Weaving" and "woven" is used in this invention relate to a method of producing a textile in which a shed is formed, that is an opening caused by separating some parallel essentially straight threads in a layer of such parallel straight threads (warp threads) from others of this layer and inserting another thread (weft thread) through the open shed followed by closing the shed to trap the weft. The textile is compacted by moving a comb-like device called the reed in which there are slits called dents against the latest inserted weft to force it (called beating) against the penultimate weft thread in the fell of the developing textile. Weaving can be distinguished over knitting in which the textile fabric is produced by combining loops together, which aren't straight. The knitting is produced from a one component yarn—either a single yarn in the case of weft knits or a parallel group of yarns in the case of warp knits.

"Trapping" of a thread, yarn or fiber in accordance with the present invention is at least the trapping in a shed by opening the shed and closing it again.

"Warp" refers to a set of yarn that runs lengthwise and parallel to the selvage and is interwoven with the weft or "filling".

"Warp yarn separation distance" refers to the distance between warp yarns when on the loom.

"Weft" refers to the yarn running from selvage to selvage at right angles to the warp. Sometimes called "filling". Each crosswise length of yarn is called a "pick".

"Yarn" is a generic name referring to a continuous strand of one or more textile fibers, filaments, or material used in weaving. A yarn may take many forms, e.g. a number of fibers twisted together (spun yarn), a number of filaments laid together without twist, a number of filaments laid together with some twist, a single filament with or without twist, a narrow strip of material such as paper, plastic film or metal; or similar.

"Shed" refers to a path through and perpendicular to the warp in the weaving loom. It is formed by raising some warp threads while others are left down. The weft yarn passes through the shed top insert the weft or filling.

"Pile yarn" refers in this invention to a yam which interlaces between two woven textile structures which are parallel to each other ("face-to-face"). In accordance with the present invention the pile yarns may be associated with the warp yarns (warp pile) or with the weft yarns (weft pile) or may be independent of either. Pile yarns are conventionally used in the manufacture of pile carpets and velvets.

"Shaft", sometimes known as harness, refers to a frame holding the heddles during weaving. A heddle is a cord, round steel wire or flat strip with a loop, eye or similar through which one or more warp yams pass to allow control of that or those yarns during weaving. The shed is formed by raising and lowering the shaft or harness.

"Doup" refers in this invention to a cord, round steel wire or flat strip with a loop, eye or similar through which one or more warp yams pass to allow additional control of that or those yams during weaving. Doups may be all attached to a doup bar to allow simultaneous movement of all doups attached to that bar. The present invention makes advantage use of relative and synchronized motion between the doups and heddles on the loom.

A useful reference is the Dictionary of Fiber & Textile Technology, HHHoechst Celanese Corp., 1990.

Figure 2:
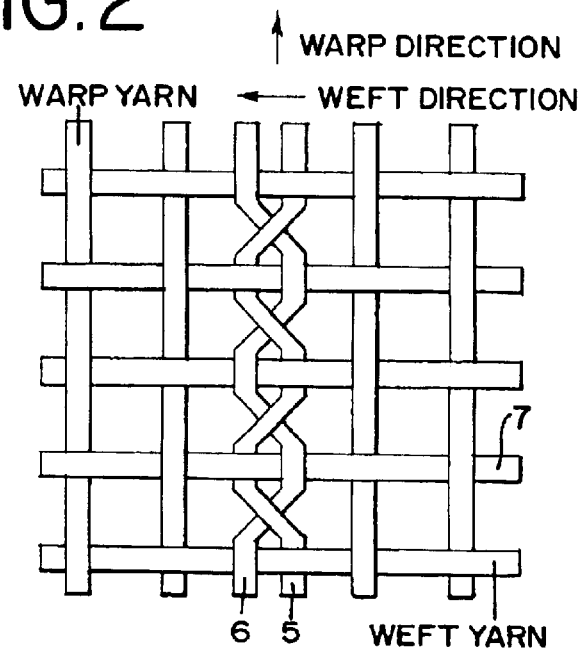
FIG. 2: Weave structure using standard leno device

Description of the Illustrative Embodiments Showing Methods to Provide any Angle ±ϕ and/or any Angle ±θ and/or any Angle ±ψ Pile of 3-D Sandwich Preforms Some of the methods according to the present invention are very remotely related to conventional leno weaving techniques, where one warp yarn is manipulated so that it forms a crossed shed with the adjacent warp yarn(s). There is a very wide range of devices to achieve leno weaving available to the textile industry, which are used primarily to provide a stable selvedge on single weft insertion looms. This type of mechanism is positioned behind the reed, level with the normal shedding arrangement, at the edges of the warp for the main fabric. FIG. 1 shows one leno method to produce a crossed shed, while FIG. 2 shows the resulting woven structure when used for a single layer fabric. Basically, by pulling on warp yarn 5 using doup 1 this yarn can be dragged across in the weft direction so that it forms a shed on the other side of warp yarn 6 from its neutral position. After weft insertion of weft yarn 7, doup 1 is lowered and warp yam 5 returns to its neutral position. The next formation of a shed and weft insertion of weft yarn 8 results in a conventional weave fell. The result of alternating the operation of doup 1 is as shown in FIG. 2. A leno weave is a weave in which the warp yarns are arranged in pairs with one warp yarn twisted around the other of the pair between picks of weft yarn.

Figure 3:
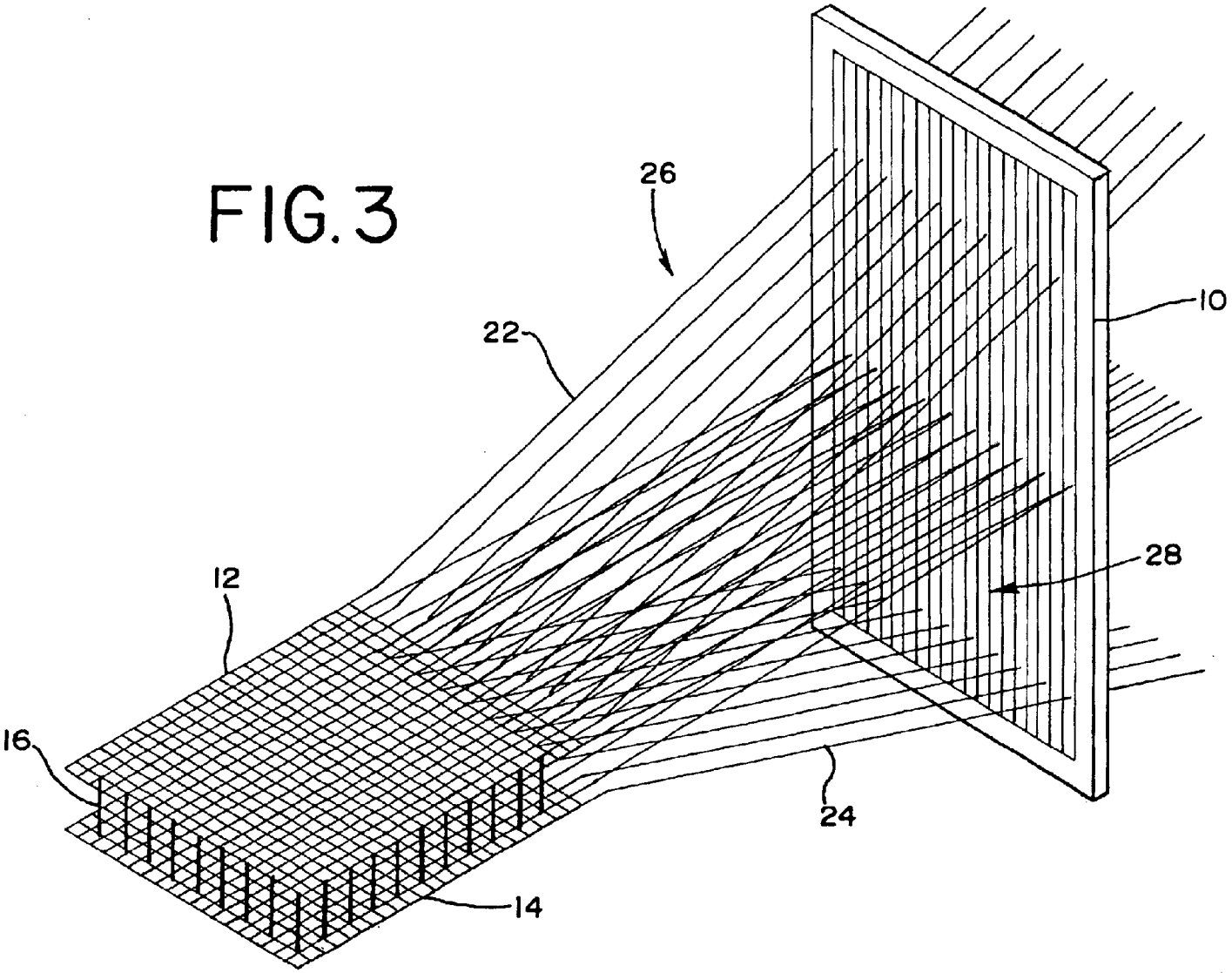
FIG. 3: Principle of face-to-face velvet weaving showing two sheds—one for upper fabric formation and the other for lower fabric formation—the layers are joined by 'pile' yarns

In one embodiment of the present invention a pile yarn is traversed across the weft-wise direction between two fabric layers which are being woven. FIG. 3 illustrates a weaving arrangement to produce two fabric or textile layers 12, 14 simultaneously, which can be joined together by 'pile' or uniting yams 16. This may be made on a conventional face-to-face loom. Basically, upper and lower sets of warp yarns 22, 24 may be formed into separate sheds 26, 28 by moving the relevant shaft and heddles. These sheds 26, 28 may be formed at the same time or one after another. A pile yarn 16 may be formed by allowing a yarn associated with the upper set 22 to be trapped in the lower set 24 and/or vice versa. The yarns which are trapped may be warp yarns but the present invention is not limited thereto. The trapped yarns may be weft yarns in accordance with some of the embodiments of the present invention or may be a combination of weft and warp yarns or include additional yarns which are not closely associated with either warp or weft yarns of the two fabrics 14, 16 and are specifically provided as uniting or pile yarns. In accordance with embodiments of the present invention a radical departure is made from conventional leno techniques. Instead of manipulating warp yarns behind the reed 10, pile yarns are manipulated in front of the reed 10.

Figure 4:
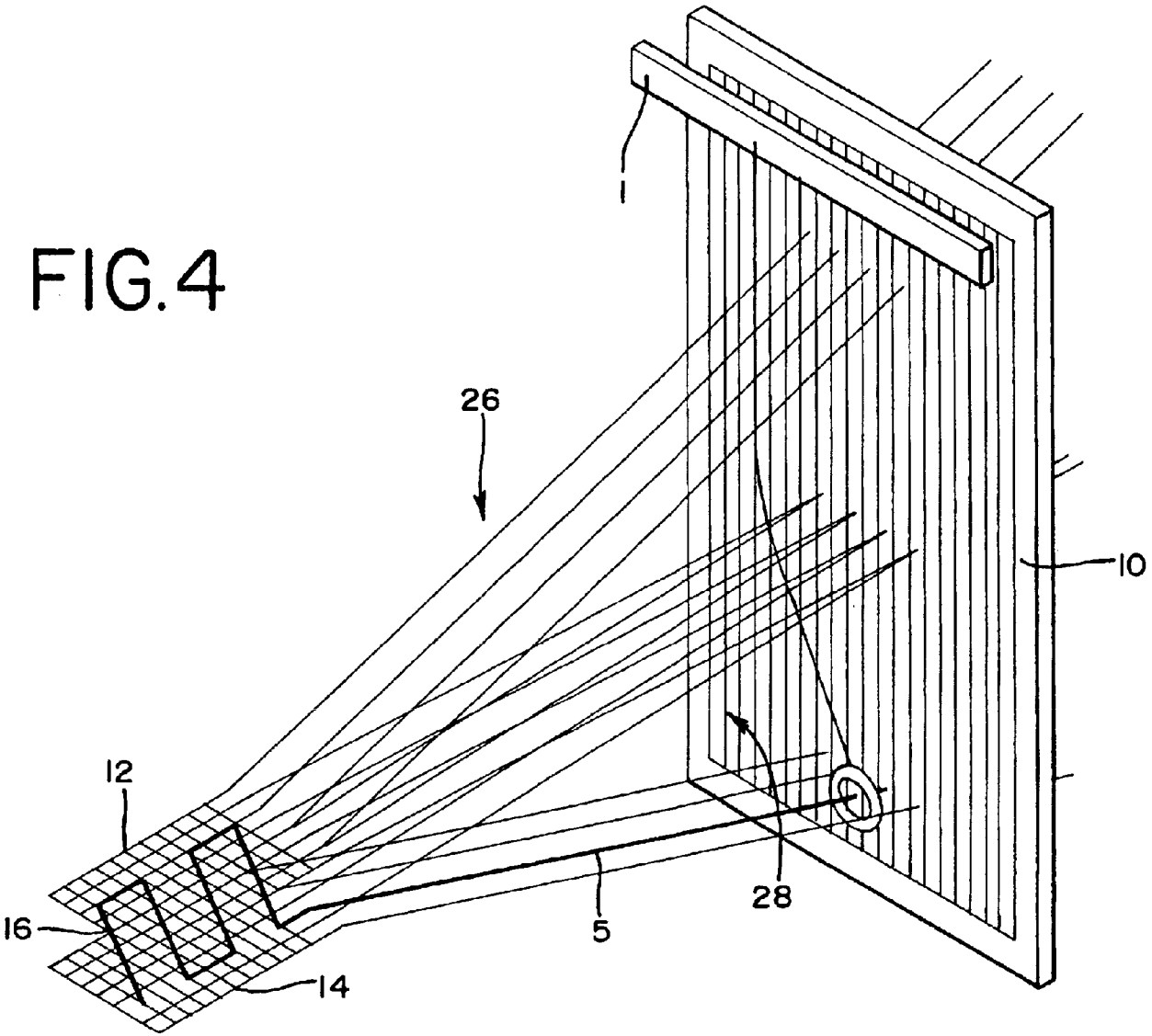
FIG. 4: Single doup joined to ring around traverse crossing warp yam in bottom shed in accordance with an embodiment of the present invention.
Figure 5:
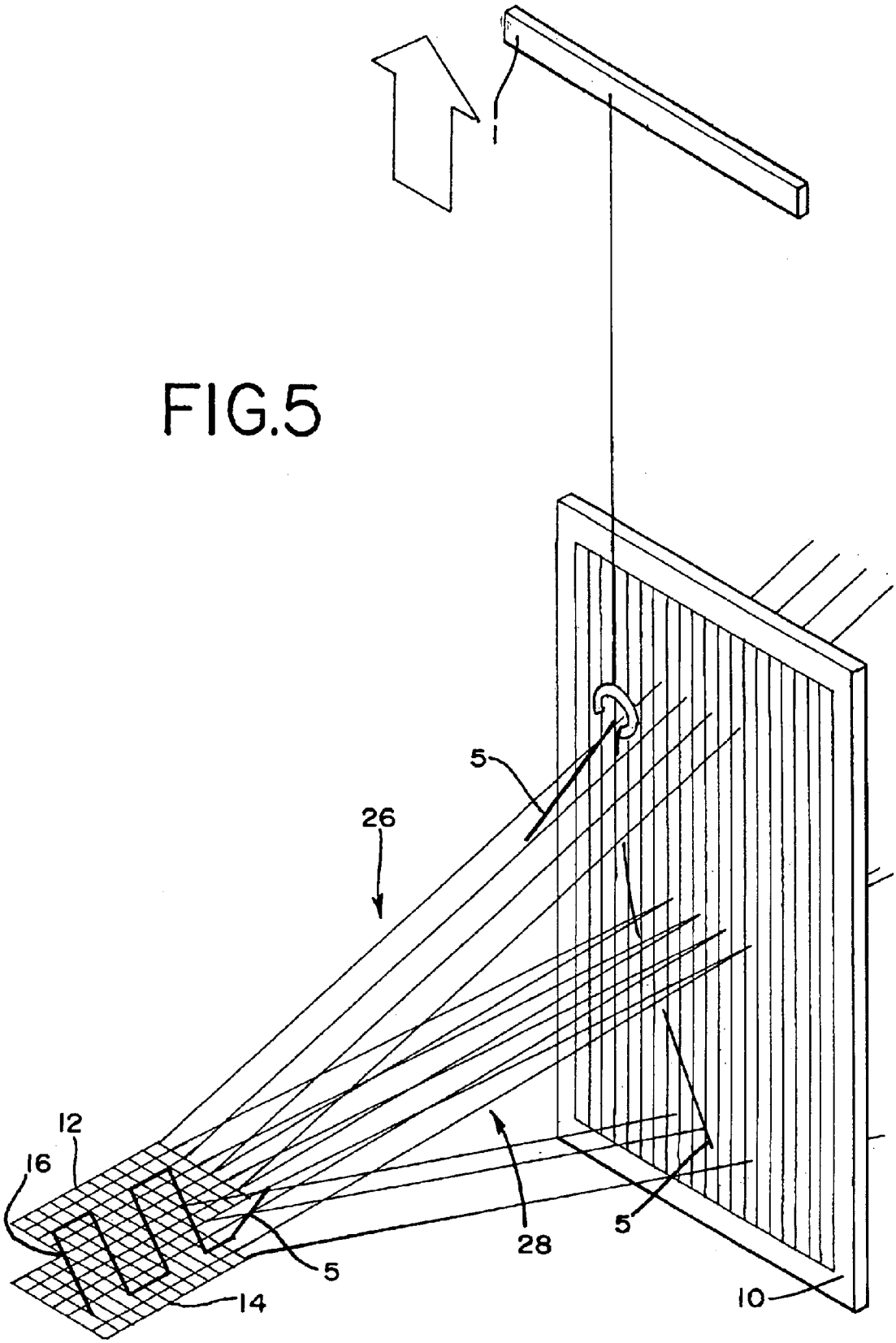
FIG. 5: Doup lifted to bring crossing warp yam to offset position in top shed in accordance with the embodiment shown in FIG. 4.

FIGS. 4 and 5 show the basic configuration of cord doup 1 in front of the reed 10 to allow high weft-wise traverse of pile yarns. In FIG. 4 the yarn 5 is currently last woven into the lower layer 14 using shed 28 and weft insertion. As shown in FIG. 5, the yarn 5 is pulled up and across in the weft direction by doup 1 into shed 26 at a position displaced by at least one warp yarn separation distance and woven into the upper layer 12, at a position off-set in the weft direction from the lower weaving point, by weft insertion into shed 28. When the movement of doup 1 into its raised and lowered positions is carried out repetitively the result is an angled pile yarn 16. Depending upon the spacing between the fabric layers 12 and 14 and the traverse distance of the warp yarn 5 provided by doup 1, this method provides pile or uniting yarns having a direction which makes at any suitable angle (θ) between 0 and 90° C., e.g. +15° or 75° or −15° to 75° to the plane of the fabric sheets 12, 14 in any given position across the preform.

Figure 6:
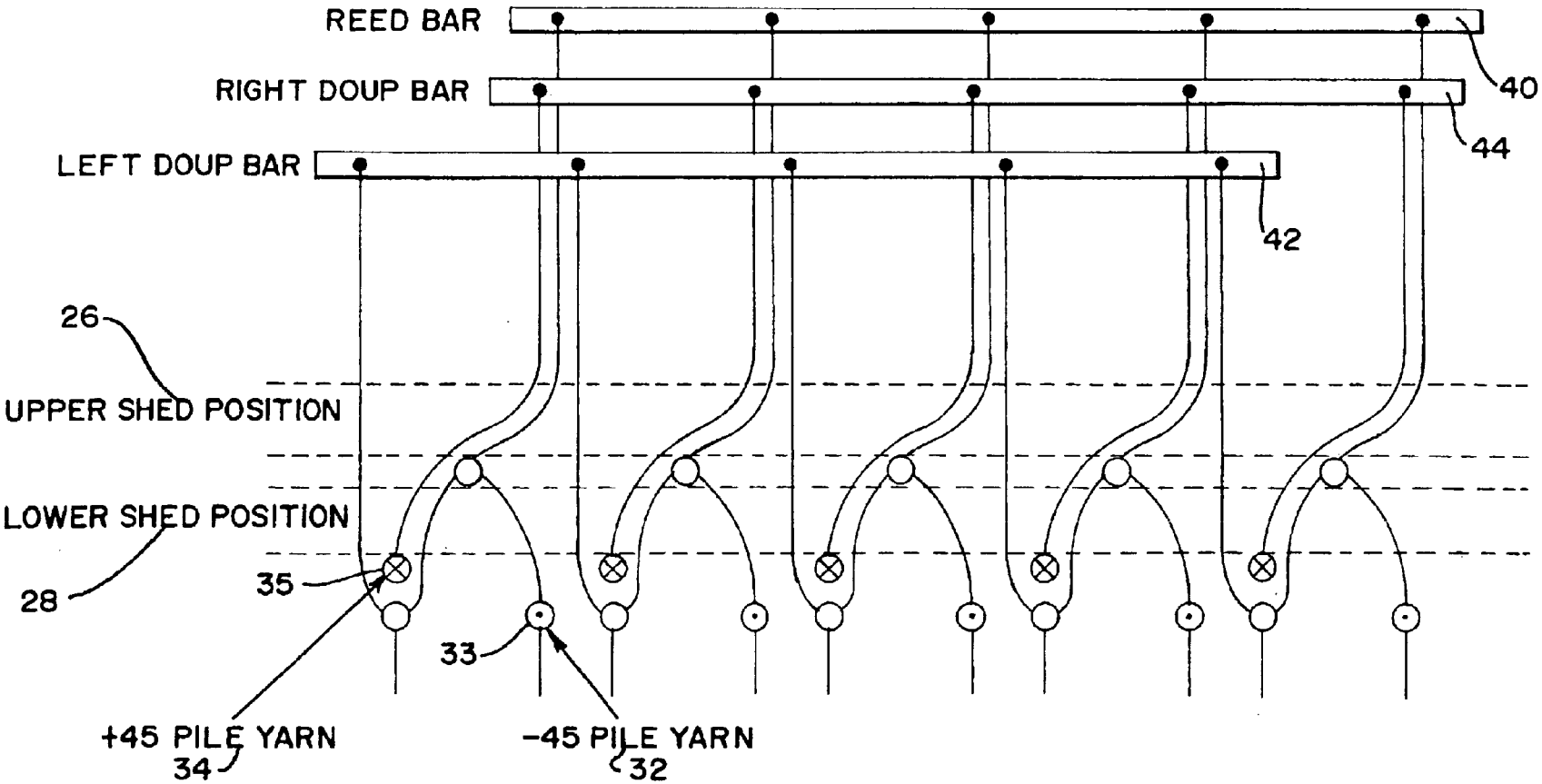
FIG. 6: Doup arrangement in lower position for simultaneous ±45° weft pile continuously across preform in accordance with an embodiment of the present invention.
Figure 7:
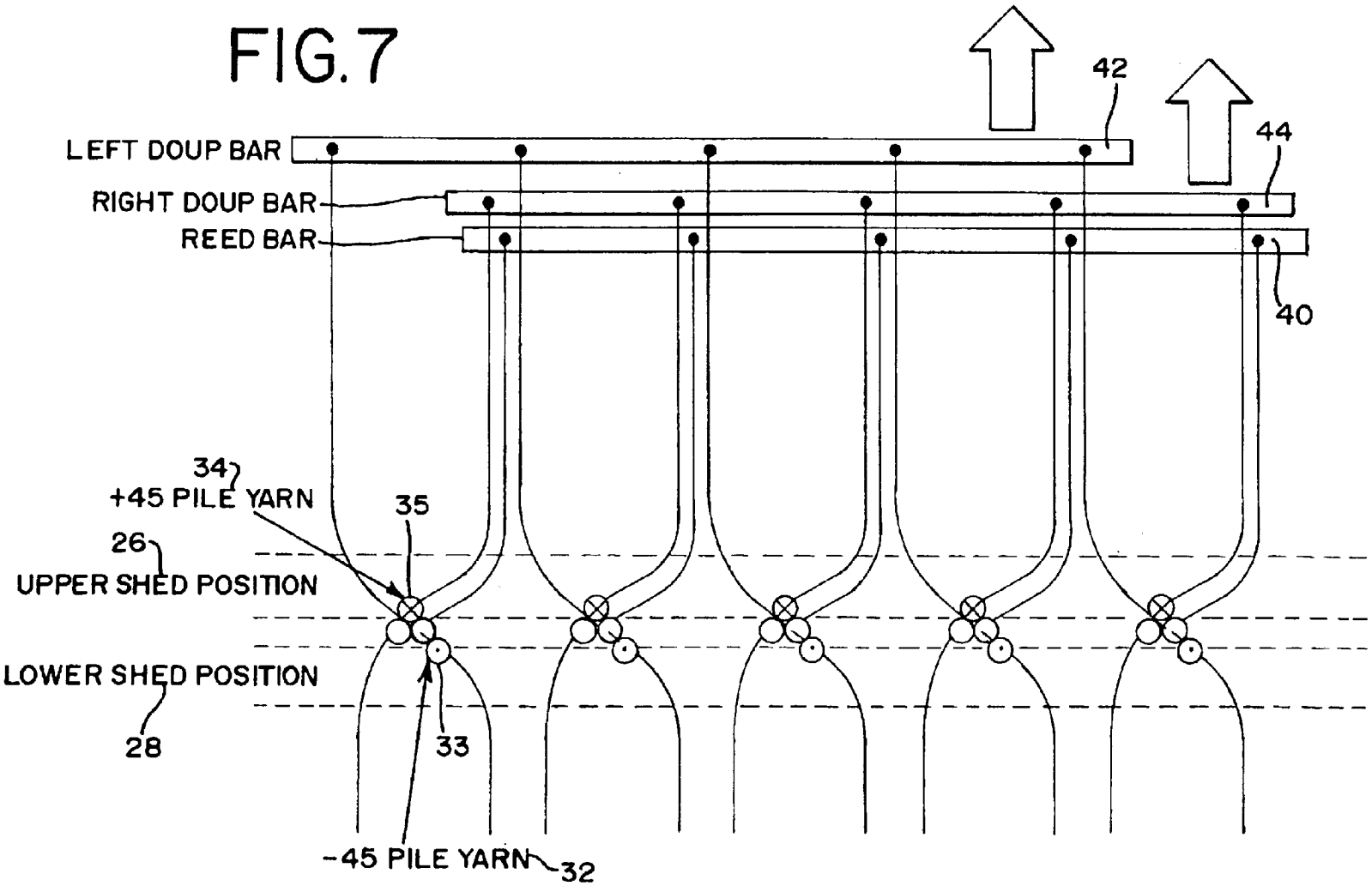
FIG. 7: Doup arrangement in middle position for ±45° weft pile in accordance with the embodiment of FIG. 6.

FIG. 6 is looking along the warp from the fell to the warp beam (i.e. in the direction of the reed 10), and shows one possible stringing arrangement to produce ±45° weft-wise traverse of the pile between two layers 12, 14 of a sandwich preform. Only the pile yarns are shown, other warp yarns have been omitted for clarity reasons. The yarns 32, 34 which will become the −45° pile yarn and +45° pile yarn, respectively, pass through rings 33, 35 attached to the left doup bar 42 and right doup bar 44, respectively. FIG. 7 shows the doup bars 42, 44 in the middle position. Here, the yarns 32, 34 have been moved to the upper side of lower shed 28 so that on repetitive weft insertion and closure of the shed 28 and repetitive raising and lowering the doup bars 42, 44, a normal weave into the lower fabric 14 is achieved. By moving the doup bars 42, 44 between the lower (FIG. 6) and middle positions (FIG. 7) on subsequent picks, the pile yarns 32, 34 can be woven into the lower fabric 14. The present invention is not limited to moving the doup bars 42, 43 on subsequent picks.

Figure 8:
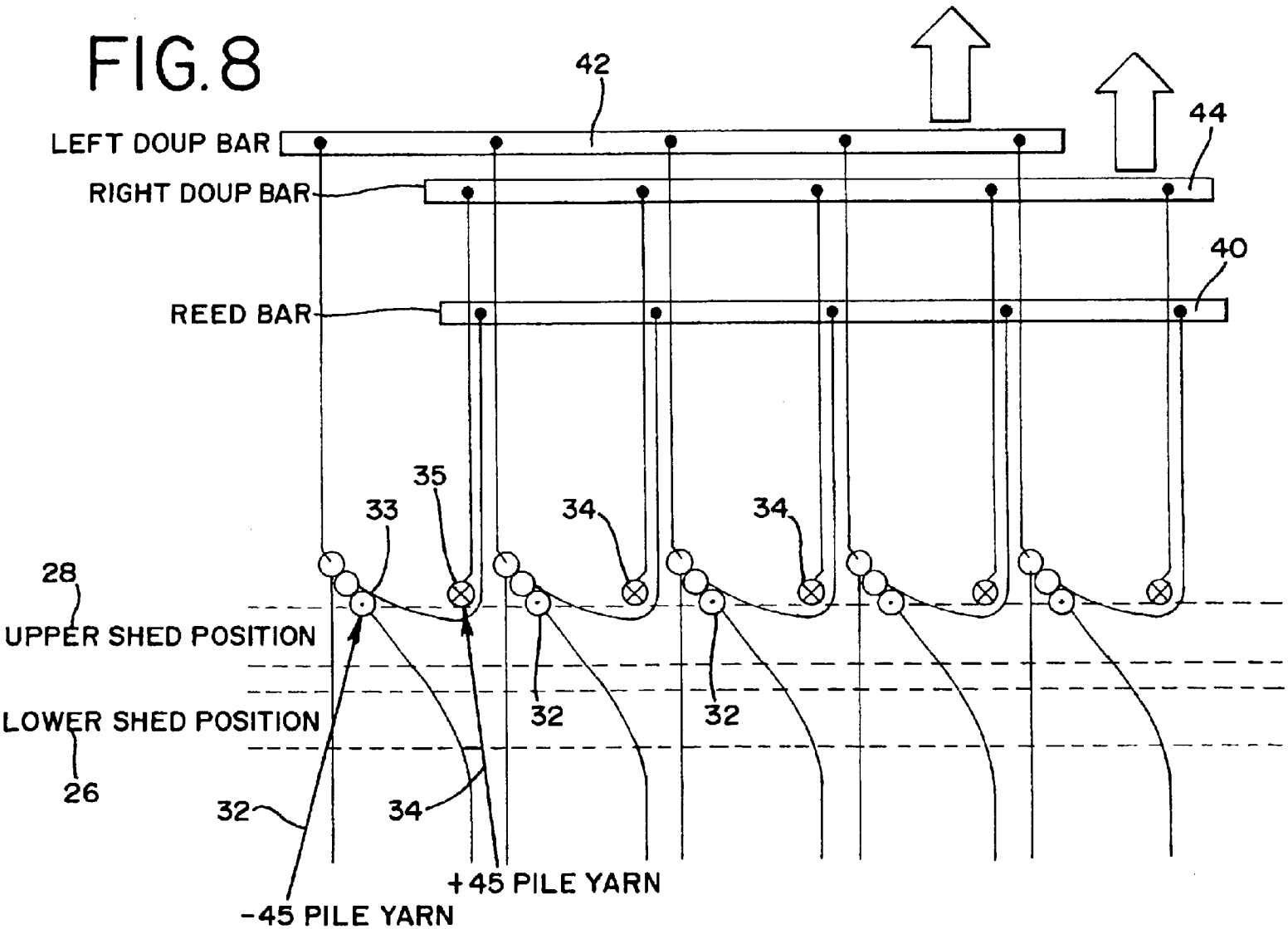
FIG. 8: Doup arrangement in upper position for ±45° weft pile in accordance with the embodiment of FIG. 5.

FIG. 8 shows the doup bars 42, 44 in the upper position. Moving the doup bars 42, 44 between the middle and upper positions (FIGS. 7 and 8, respectively) on subsequent picks enables the pile yarns 32, 34 to be woven into the upper fabric 12 by weft insertion and opening and closing of shed 26, but the trapping position in the upper fabric 12 is at a position off-set with respect to the lower layer 14. This offset is in the weft direction but a component may also be in the warp direction. This is achieved by not changing the position of the doup bars 42, 44 at every pick but waiting for a number of weft insertions before the change. This produces a uniting yarn of the two fabrics 12, 14 which has a direction component in the weft direction and in the warp direction, i.e. a diagonal uniting yarn which can have any angle (θ) to the plane of the fabrics along the warp direction. Extending these movements of the doup bars 42, 44 from the lower to upper layer 14, 12 will give a ±45° weft-wise configuration of the binder yarns. By altering the lift sequence of the shedding mechanism and the doup bars 42, 44, the angle of the binder yarns traversing from one fabric 12, 14 to the other 14,. 12, can be made at any angle between the weft and the warp, as illustrated in the top view in FIG. 9 in which the angle to the warp threads is (φ) as seen from the top as well as having (optionally) angles θ and ψ to the fabric planes in the weft and warp direction respectively. These angles may be anywhere between 0and 90°, for example between 15 and 75°. Looking from the top or either of the sides, the uniting yarns may form a series of "X's" by trapping the pile yarns in the upper and lower fabrics at the appropriate positions. There is a large number of structures which can be generated using this method in conjunction with regular weaving techniques all of which are individual embodiments of the present invention. Although in the above, uniting threads have been described as being trapped in a first fabric and in the second fabric, the present invention also includes trapping a uniting thread in one fabric and then trapping the same thread in the same fabric at a different position displaced either in the weft direction and/or the warp direction or in a combination of warp and weft directions.

Figure 9:
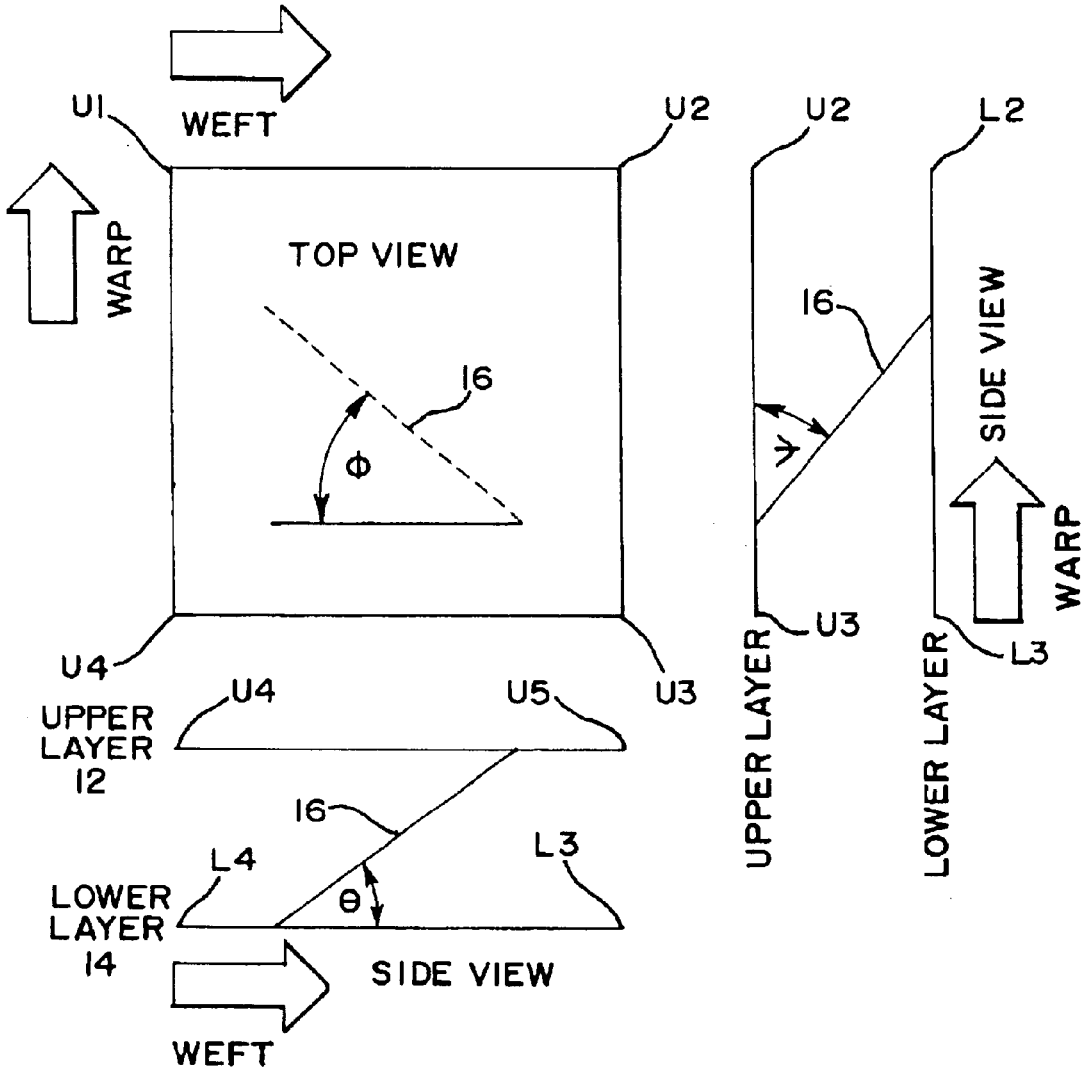
FIG. 9: shows a weaving cell in accordance with an embodiment of the present invention. A binder yarn can be at any angle (ϕ) to warp yarns and can traverse from upper layer to lower layer of fabric or remain in one fabric.

One aspect of the present invention is a 3-D weaving cell which when repeated (tiled) across the fabrics 12, 14 may produced 3-D woven preforms with advantageous properties. A 3-D weaving cell as shown in FIG. 9 may be a rectangular box with corners designated by U1–U4 in the upper fabric and L1–L4 in the lower fabric. The present invention includes trapping uniting threads in such a way that they traverse between the following points in any combination:

L4 to U3, L3 to U4, U4 to U3, L4 to L3, U3 to L2, U2 to L3, U3 to U2, L3 to L2, U1 to L2, U2 to L1, U1 to U2, L1 to L2, U1 to L4, U4 to L1, U1 to U4, L1 to L4, U1 to L3, L1 to U3, U2 to L4, L2 to U4, U1 to U3, U2 to U4, L1 to L3, L2 to L4, U1–L1, U2–L2, U3–L3, U4–L4. It is understood that the displacement in the fabric between U1 and U2 or U1 and U4 is at least one warp or weft separation spacing. As can be seen from FIG. 9 the uniting thread 16 may take on any combination of angles φ, θ, ψ. Although the present invention may include any fabric pair 12, 14 in which there is at least one uniting thread any one of or combination of the angles φ, θ, ψ, there may be limitations on producing uniting fibers with some of these combinations all at one place within the fabric structure formed from fabrics 12, 14 and the uniting threads. The may be difficulties in creating some of these combinations simultaneously, e.g. the loom control may be very complicated and/or slow in operation.

Figure 10:
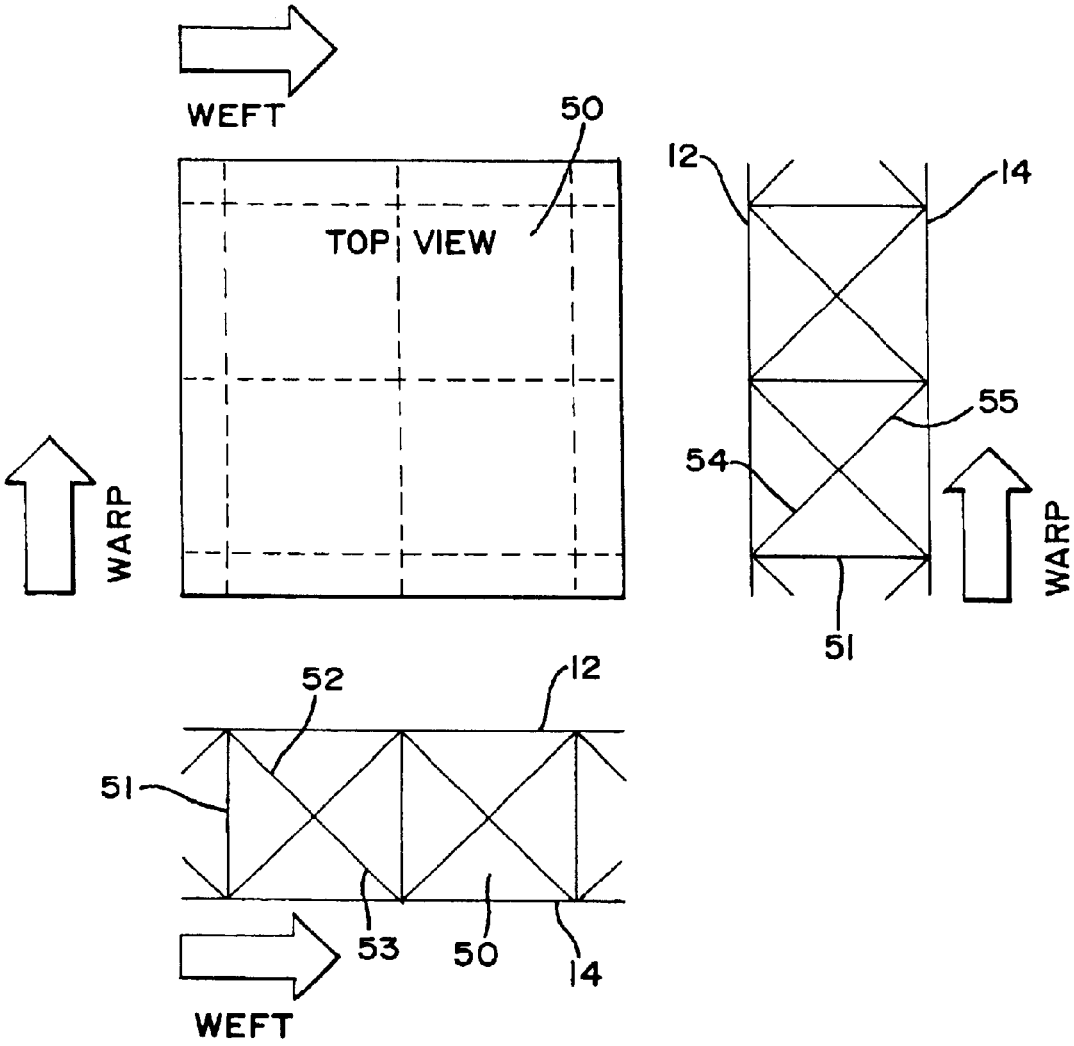
FIG. 10: Structure with any angle ±θ° weft direction, and any angle ±ψ° warp direction and optional orthogonal binder reinforcing

An embodiment of the present invention having ±45° weft direction, combined with ±45° warp direction and orthogonal binder reinforcing for a sandwich preform, is illustrated in FIG. 10 and includes "X" formations as seen from either side view as well as vertical uniting threads between the two fabrics 12, 14. The distance between the fabric layers 12, 14 can range upward from zero and is limited only by the loom dimensions. Further, there can be any number of layers in the sandwich structure, with the binder (uniting thread) configuration described here provided between adjacent fabric layers. It is not necessary that the binder configuration is the same between all the layers. FIG. 10 shows a weaving cell 50 which is tiled in the warp and weft directions to form a 3-D woven fabric in accordance with an embodiment of the present invention. Four cells 50 are shown. When looking along the warp yams, the face of each weaving cell 50 comprises a vertical uniting thread at each edge and two face diagonal yarns 52, 53. The view along the weft yarns in similar with diagonal yarns 54, 55 in the face of the cell visible from this view. From the top no X forms can be seen. The resulting structure may be coated or impregnated with thermosetting or thermoplastic resin to form a 3-D structural element having improved shear strength caused by the diagonal uniting yarns 52 and 53. Optionally diagonal-uniting yarns may be provided which travel diagonally across the weaving cell.

Figure 11:
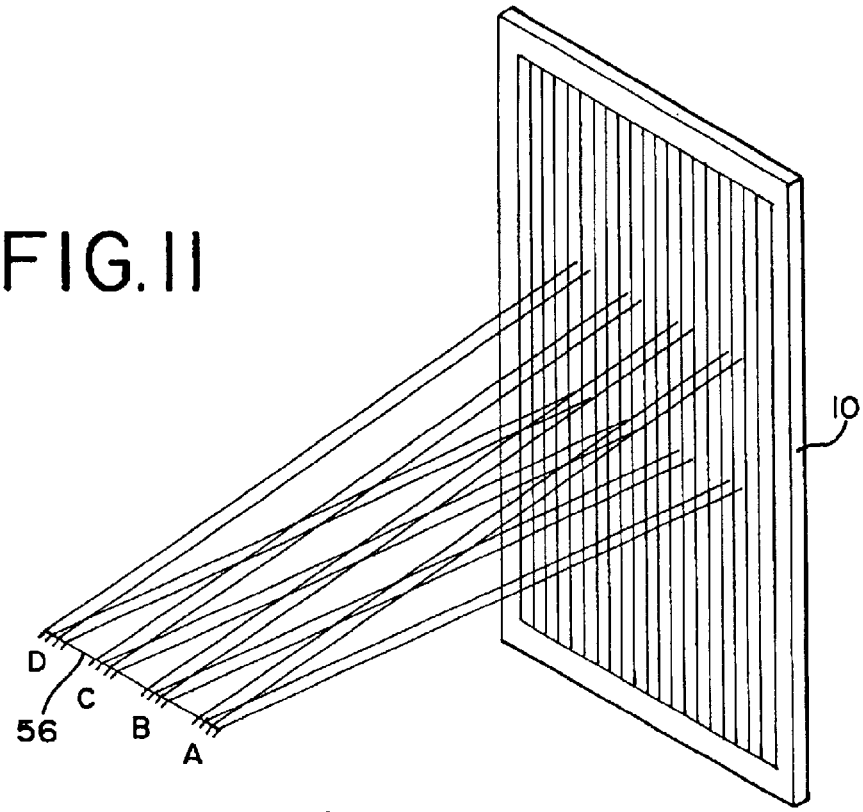
FIGS. 11 and 12 show shed positions of a further embodiment of the present invention in which uniting yarns are produced by weft insertion.
Figure 12:
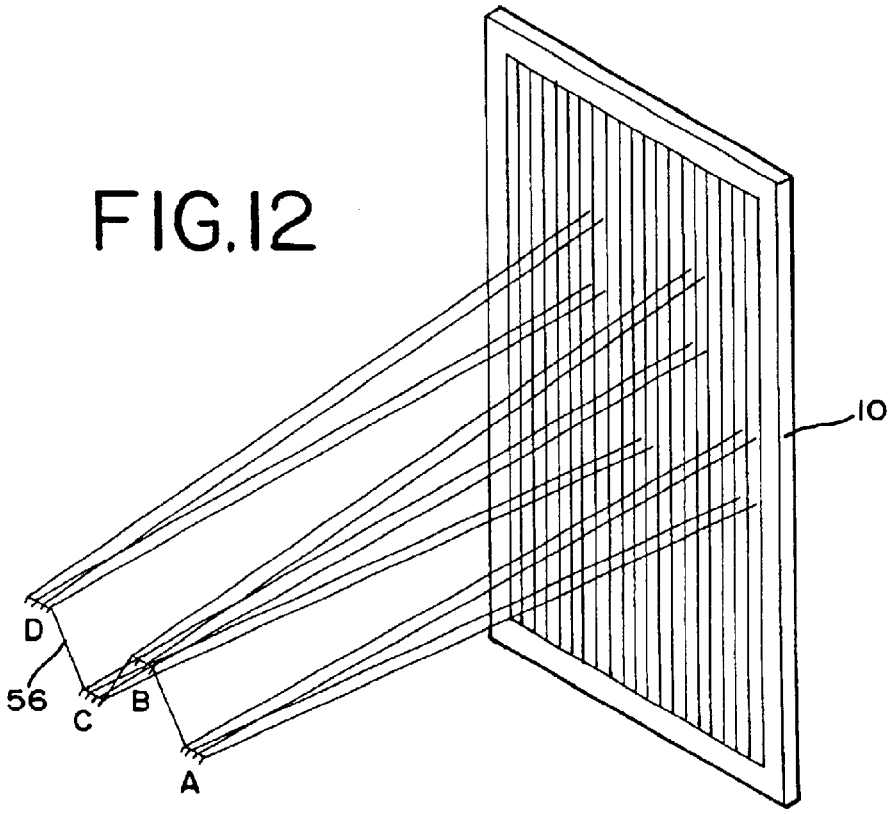

In accordance with another embodiment of the method in accordance with the present invention, similar structures may be achieved by using weft yarn to provide the weft-wise uniting pile binders. This requires a significantly different shedding arrangement than the above embodiment, and a high level of control of the weft yarn feed. One method of manufacturing is illustrated in FIGS. 11 and 12. The method splits up the warp yarns of the upper and lower sets of yarns 22, 24 to form a shed whose upper and lower layers are each formed from a mixture of warp yarns from the upper and lower sets 22, 24. Hence, selected yarns from both layers of the sandwich panel form a single shed. A weft yarn that will form part of the 45 weft-wise reinforcing is inserted into the thus formed "composite" shed. Subsequently part of the shed, is closed and then moved down, whereas another section is closed and then moved up, this continues across the shed to the other side of the fabric. To provide matching reinforcing in the other direction, the yarns selected into the shed are changed, and the process repeated.

This procedure is shown schematically in FIGS. 11 and 12. First as shown in FIG. 11 groups of yams A, B, C, D from the yarn sets of the different fabrics 12, 14 are aligned and a shed opened to allow insertion of a weft thread 56. Then the groups of yarns A, C are moved down and the groups B, D moved up into the neutral positions for the two fabrics 12, 14 as shown in FIG. 12. To do this weft yarn 56 must be drawn into the fabric structure. Hence, it is preferred if the sheds are not closed as the groups A, C and B, D respectively are moved. Closing of the sheds would increase the frictional forces necessary to draw the additional weft thread 56 into the structure. This method of weft insertion will provide uniting threads having a direction with an angle of between 15 and 75° to the plane of the individual fabric sheets 12, 14 and with its main component in the weft direction.

Leno-based weaving devices have a number of positive aspects. Most importantly they are existing technology in the textile manufacture area. In accordance with the present invention these weaving tools have been configured in quite a unique way—but they are readily available. In addition, they can be added to existing weaving equipment, with relatively small modifications to the machinery.

There is an infinite variation in the structures achievable using the techniques according to the present invention, although mainly ±45° in the weft direction has been described above. Importantly, they can also be combined with ±45° warp direction and orthogonal reinforcing. There are trade-offs between the range of pile architectures in one fabric, and the level of loom control required. The number of shafts and the number of binder yarn feeding devices increases as the architecture becomes more complex.

While the invention has been shown and described with reference to preferred embodiments, it will be understood by those skilled in the art that various changes or modifications in form and detail may be made without departing from the scope and spirit of this invention as defined in the attached claims. For example, the invention has mainly been illustrated with reference to uniting threads having ±45° angle to the plane of the fabrics 12, 14 but the present invention is not limited thereto. The woven 3-D woven structures produced in accordance with the present invention may be coated, e.g. dip coated or solvent coated or hot melt coated, or impregnated with a thermosetting or a thermoplastic resin. The word resin is given its widest meaning including polymers in general, e.g. plastics, rubbers, elastomers. The 3-D woven structures may also be embedded into suitable materials, e.g. resins, foams, both thermoplastic or thermosetting. Further, although the present invention has been described mainly with respect to flat fabrics, the present invention may also be used to weave non-flat structures such as double wall tubes with uniting threads between the walls of the tube. Each wall of the tube is formed from one of the fabric layers 12, 14.

Although the present invention has mainly be described with reference to a two-layer structure, it is not limited thereto and may include multi-layer structures.

What is claimed is:

1. A method of weaving a fabric structure comprising at least two woven fabric sheets each made up of warp and weft threads on a loom, the fabric sheets being parallel to and facing each other, comprising the steps of:

linking the at least two fabric sheets to each other by first uniting threads by trapping at a position in a first of the at least two fabric sheets a first of the first uniting threads so that it has a direction component in the weft direction which makes an angle of between +15° and +75° with the plane of the fabric sheets and trapping a second of the first uniting threads at a position in a second of the at least two fabric sheets opposite the trapped position of the first one so that it has a direction component in the weft direction which makes an angle of between −15° and −75° with the plane of the fabric sheets to form an X when viewed along the warp direction, the X profile lying in a plane perpendicular to the plane of the at least two fabric sheets and which is parallel to the weft direction.

2. The method according to claim 1, further comprising the step of trapping a second uniting thread in the first fabric sheet and subsequently trapping the same thread in the second fabric sheet so that the direction of the second uniting thread is substantially perpendicular to the plane of the fabric sheets.

3. The method according to claim 1, wherein the trapping of at least some of the first uniting threads is carried out so that the direction of these first uniting threads also has a component in the warp direction which makes an angle of between +15° and +90° or between −15° and −90° with the plane of the fabric sheets.

4. The method in accordance with claim 1, wherein trapping of at least some of said first uniting threads is carried out so that the direction of these first uniting threads has a component which lies in a plane parallel to the planes of the first and second fabric sheets and makes an angle of between +15° and +165° or between −15° and −165° with the direction of the warp threads.

5. The method in accordance with claim 1, further comprising the step of trapping a third uniting thread in a first position in a first of the two fabric sheets and in the second of the two fabric sheets at a second position equivalent to a position at least one weft thread removed from the first position so that the direction of said third uniting thread has a component in the warp direction which makes an angle of between +15° and +75° or between −15° and −75° with the plane of the fabric sheets.

6. The method according to claim 1, further comprising the step of trapping a fourth uniting thread between the two fabric sheets so that the direction of said fourth uniting thread has a component in the warp direction which lies in a plane parallel to the planes of the first and second fabric sheets and which makes an angle of between +15° and +165° or between −15° and −165° with the direction of the warp threads.

7. The method according to claim 6, wherein the third and fourth threads are the same threads.

8. The method according to claim 5, wherein the trapping of the third uniting threads is carried out so that some of the third uniting threads have a direction component in the warp direction which makes an angle of between +15° and +75° with the plane of the fabric sheets whereas other third uniting threads have a direction component in the warp direction which makes an angle of between −15° and −75° with the plane of the fabric sheets.

9. The method according to claim 8, wherein the trapping of one of the third uniting threads so that it has a direction component in the warp direction which makes an angle of between +15° and +75° with the plane of the fabric sheets at a position in a first of the two fabric sheets and trapping a second of the third uniting threads so that it has a direction component in the warp direction which makes an angle of between −15° and −75° with the plane of the fabric sheets at a position in a second of the two fabric sheets opposite the trapped position of the first one to form an X profile when viewed along the weft direction.

10. The method according to claim 1, wherein the step of forming the X profile comprises:

threading a portion of a first thread under a second warp thread in the first fabric;

moving portions the first and second warp threads in a weft direction while raising both of the first and second warp threads to bring the first and second warp threads into the plane of the second fabric.

11. The method of claim 10, further comprising the step:

raising and lowering the first and second warp threads in said second fabric and using weft insertion to weave the second fabric.

12. The method according to claim 1, wherein the first uniting threads are each warp or weft threads.

13. The method according to claim 2, wherein the second uniting threads are each warp or weft threads.

14. The method according to claim 5, wherein the third uniting threads are each warp or weft threads.

15. The method according to claim 6, wherein the fourth uniting threads are each warp or weft threads.

16. The method according to claim 1, in which the movement of the first uniting thread is applied in front of a reed of a weaving loom.

17. A weaving loom for weaving a fabric structure comprising at least two woven fabric sheets each made up of warp and weft threads on a loom, the fabric sheets being parallel to and facing each other, the loom comprising means for linking the at least two fabric sheets to each other by first uniting threads by trapping at a position in a first of the at least two fabric sheets a first of the first uniting threads so that it has a direction component in the weft direction which makes an angle of between +15° and +75° with the plane of the fabric sheets and trapping a second of the first uniting threads at a position in a second of the at least two fabric sheets opposite the trapped position of the first one so that it has a direction component in the weft direction which makes an angle of between −15° and −75° with the plane of the fabric sheets to form an X when viewed along the warp direction, the X profile lying in a plane perpendicular to the plane of the at least two fabric sheets and which is parallel to the weft direction.

18. A weaving loom according to claim 17 having means to carry out the method of weaving a fabric structure, including trapping a second uniting thread in the first fabric sheet and subsequently trapping the same thread in the second fabric sheet so that the direction of the second uniting thread is substantially perpendicular to the plane of the fabric sheets.

19. A weaving loom according to claim 17 having means to carry out the method of weaving a fabric structure, including trapping of at least some of the first uniting threads is carried out so that the direction of these first uniting threads also has a component in the warp direction which makes an angle of between +15° and +90° or between −15° and −90° with the plane of the fabric sheets.

20. A weaving loom according to claim 17 having means to carry out the method of weaving a fabric structure, including trapping of at least some of said first uniting threads is carried out so that the direction of these first uniting threads has a component which lies in a plane parallel to the planes of the first and second fabric sheets and makes an angle of between +15° and +165° or between −15° and −165° with the direction of the warp threads.

* * * * *